US006883586B2

(12) United States Patent
Weyer et al.

(10) Patent No.: US 6,883,586 B2
(45) Date of Patent: Apr. 26, 2005

(54) STRIP GUIDE FOR A STRIP-CASTING UNIT AND ADJUSTING DEVICE FOR THE ROLLER SEGMENTS THEREOF

(75) Inventors: Axel Weyer, Wuppertal (DE); Peter Jonen, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/467,540

(22) PCT Filed: Jan. 19, 2002

(86) PCT No.: PCT/EP02/00489

§ 371 (c)(1),
(2), (4) Date: Nov. 24, 2003

(87) PCT Pub. No.: WO02/064291

PCT Pub. Date: Aug. 22, 2002

(65) Prior Publication Data

US 2004/0065431 A1 Apr. 8, 2004

(30) Foreign Application Priority Data

Feb. 10, 2001 (DE) ..... 101 06 252

(51) Int. Cl.[7] ..... B22D 11/128

(52) U.S. Cl. ..... 164/484; 164/441; 164/442; 164/448

(58) Field of Search ..... 164/484, 448, 164/441, 442

(56) References Cited

U.S. PATENT DOCUMENTS 4,544,015 A * 10/1985 Scheurecker et al. ..... 164/442
6,145,575 A * 11/2000 Leingruber ..... 164/151.3
6,568,460 B1 * 5/2003 Kneppe et al. ..... 164/442

FOREIGN PATENT DOCUMENTS

| | | |
|---|---|---|
| WO | 9741984 | 11/1997 |
| WO | 9800253 | 1/1998 |
| WO | 9946071 | 9/1999 |

* cited by examiner

*Primary Examiner*—Kiley S. Stoner
*Assistant Examiner*—I.-H. Lin
(74) *Attorney, Agent, or Firm*—Friedrich Kueffner

(57) ABSTRACT

The invention relates to a strip guide for a strip casting unit, comprising at least two segments, in particular roller segments (1–4), each with a strip input side (2.1) and a strip output side (3.1) and a pair of roller supports, each with a number of support rollers (5), running along a support region. The roller supports are adjustable by means of, in particular, hydraulic adjuster units (8). According to the invention, the strip guide can be more flexibly embodied and the assembly and disassembly times reduced, whereby a mechanical connection (9) is provided between neighbouring segments (1–4) and, on fitting a cylinder pair (8.1–8.4) to the strip input side (2.1) of a segment (1–4), the adjustment movement occurs both on said side (2.1), as well as simultaneously on the strip output side (3.1) of a previous segment connected thereto. On fitting a cylinder pair (8.1–8.4) to the strip output side (3.1) of a segment (1 4), the adjustment movement thereof affects said side (3.1), and simultaneously the strip input side (2.1) of a subsequent section connected thereto.

10 Claims, 3 Drawing Sheets

STRIP GUIDE FOR A STRIP-CASTING UNIT AND ADJUSTING DEVICE FOR THE ROLLER SEGMENTS THEREOF

CROSS-REFERENCE TO THE RELATED APPLICATION

This application is a 371 of PCT/EP02/00489 filed on Jan. 19, 2002.

BACKGROUND OF THE INVENTION

The invention concerns a strand guide for a continuous casting plant, which comprises at least two segments, especially roll segments, each with a strand run-in end and a strand run-out end and with a pair of roll supports, which support a number of containment rolls that extend over a containment zone and which can be adjusted by adjusting units, especially hydraulic adjusting units.

The strand guide of continuous casting plants is characterized by the well-known segmental construction. In designs for hydraulic adjustments of segments, for example, for a change in section thickness, soft reduction, or other necessary position-regulated gap-width adjustments that require a continuous strand thickness reduction, each of the segments is adjusted independently of the other segments with two pairs of hydraulic cylinders comprising four individual hydraulic cylinders. An exception here is the first segment in thin slab continuous casting plants, which is equipped with only one pair of cylinders, because a bending point is usually located on the run-in side below the mold.

In the state of the art, a series of practical designs for guiding a strand and suitable strand guides for this purpose are known.

The document WO 98/00,253 describes a method for guiding a strand, especially a steel strand, in a continuous casting plant with a soft reduction zone, in which servo units provide continuously variable adjustment of the gap width between opposing strand guide rolls. In a strand guide segment with four servo piston-cylinder units, two adjacent cylinder units, which are hydraulically linked with each other, are adjusted to the strand, and the remaining cylinder units are independently subjected to continuously variable adjustment. The position of the two cylinder units that are linked is detected, compared with set points, and controlled according to preset data and a mean value. When defined distance values are exceeded, another pair of servo piston-cylinder units is linked together.

The document WO 99/46,071 concerns a method for adjusting a roll segment of a continuous casting plant, which has a segment run-in end, a segment run-out end, and a pair of roll supports, each of which supports rolls that extend over a support zone, such that the roll supports are mutually adjusted against each other by an adjusting unit installed at the segment run-in end and an adjusting unit installed at the segment run-out end, and such that each adjusting unit has two hydraulic cylinder units arranged on either side of the support zone. The hydraulic cylinder units can be adjusted both by position regulation and pressure regulation. The rolls are adjusted to a metal strand guided by the rolls by the hydraulic cylinder units by means of position regulation, and the hydraulic cylinder units are changed over from position-regulated to pressure-regulated operation when the pressure in the given hydraulic cylinder unit reaches a threshold value.

SUMMARY OF THE INVENTION

Proceeding from the state of the art, the object of the invention is to provide a new solution for the specified strand guide, which correctly carries out every necessary position-regulated gap-width adjustment for a continuous change of strand thickness with only one pair of hydraulic cylinders per strand guide segment.

In accordance with the invention, to achieve this object in a strand guide, a mechanical coupling is provided between the two segments of each set of adjacent segments, and, when a pair of cylinders is installed at the strand run-in end of a segment, its adjustment movement occurs both at this end of the segment and simultaneously at the strand run-out end of the preceding segment to which it is connected, whereas, when a pair of cylinders is installed at the strand run-out end of a segment, its adjustment movement occurs both at this end of the segment and simultaneously at the strand run-in end of the following segment to which it is connected.

In accordance with the invention, a segment is thus advantageously equipped with only two hydraulic cylinder units instead of the four hydraulic cylinder units that have been used in the past. This not only results in savings of material, but also, more importantly, significantly reduces the large amount of installation labor involved in changing segments or rolls, which greatly improves the cost situation. In addition, the regulation expense can be reduced.

One modification of the strand guide in accordance with the invention provides that the mechanical coupling between adjacent segments is a releasable sliding joint coupling. The advantage of a sliding joint coupling of this type is that only a minimum amount of joint assembly and disassembly work is required.

Furthermore, a modification of the method in accordance with the invention provides that each of the segments between the first segment and the last segment has only one pair of cylinders, which is positioned either at the strand run-in end or at the strand run-out end.

In accordance with the invention, it is proposed that, when all of the pairs of cylinders are installed at the strand run-out end, one pair of cylinders is assigned to each of the first and last segments. On the other hand, in the modification of the strand guide in accordance with the invention, it is proposed that, when all of the pairs of cylinders are installed at the strand run-in end, two pairs of cylinders are assigned to the last segment of the strand guide, one at the run-in end and one at the run-out end, and that no hydraulic cylinder is assigned to the first segment, i.e., the segment connected to the mold.

The first segment thus does not have a hydraulic cylinder. This provides a significant advantage for a variable strand guide with change of section thickness. An improvement is also realized due to the small amount of assembly work, so that, for example, in the event of a breakout, no hydraulic connections or sensor connections have to be released, closed, or replaced, which means that significantly shorter changing times are achieved.

In addition, the connection between two segments in the form of a releasable sliding joint coupling provides the necessary synchronization of a segment run-out end with the following segment run-in end or of the roll transitions of the last roll of a segment to the following roll of the next segment. The guide structures with the sliding joint coupling can be connected with the following segment without accessories due to the possibility of disassembling the segments towards the top. In this regard, the connection is held closed, for example, in the case of segments stacked one upon the other, by the effect of the weight of a segment resting above the connection.

In accordance with the invention, the method for adjusting the roll segments of the strand guide of a continuous casting plant is characterized by the fact that, in adjacent segments between the first and the last segment, a flexible coupling is produced in such a way and hydraulic adjusting units can be operated to transmit force in the region of this connection in such a way that an adjusting movement acting on one end of the segment is simultaneously transmitted to the other end of an adjacent segment.

A modification of the adjusting method in accordance with the invention provides that a releasable sliding joint is used to produce a flexible connection between each two adjacent segments. It is advantageous if the adjusting movement occurs in the same direction and over the same distance in each case.

As has already been explained, a sliding joint coupling of this type allows flexible assembly with significant savings of assembly time and in this way reduces the production shutdown costs associated with a shutdown of the plant.

Finally, the adjusting method in accordance with the invention provides that, corresponding to an adjusting movement of the strand run-in end of the last segment, an adjusting movement at its strand run-out end is separately produced by hydraulic means.

Further details, features, and advantages of the invention are revealed in the following explanation of the embodiment shown schematically in the drawings.

DETAILED DESCRIPTION OF THE INVENTION

Figure 1:
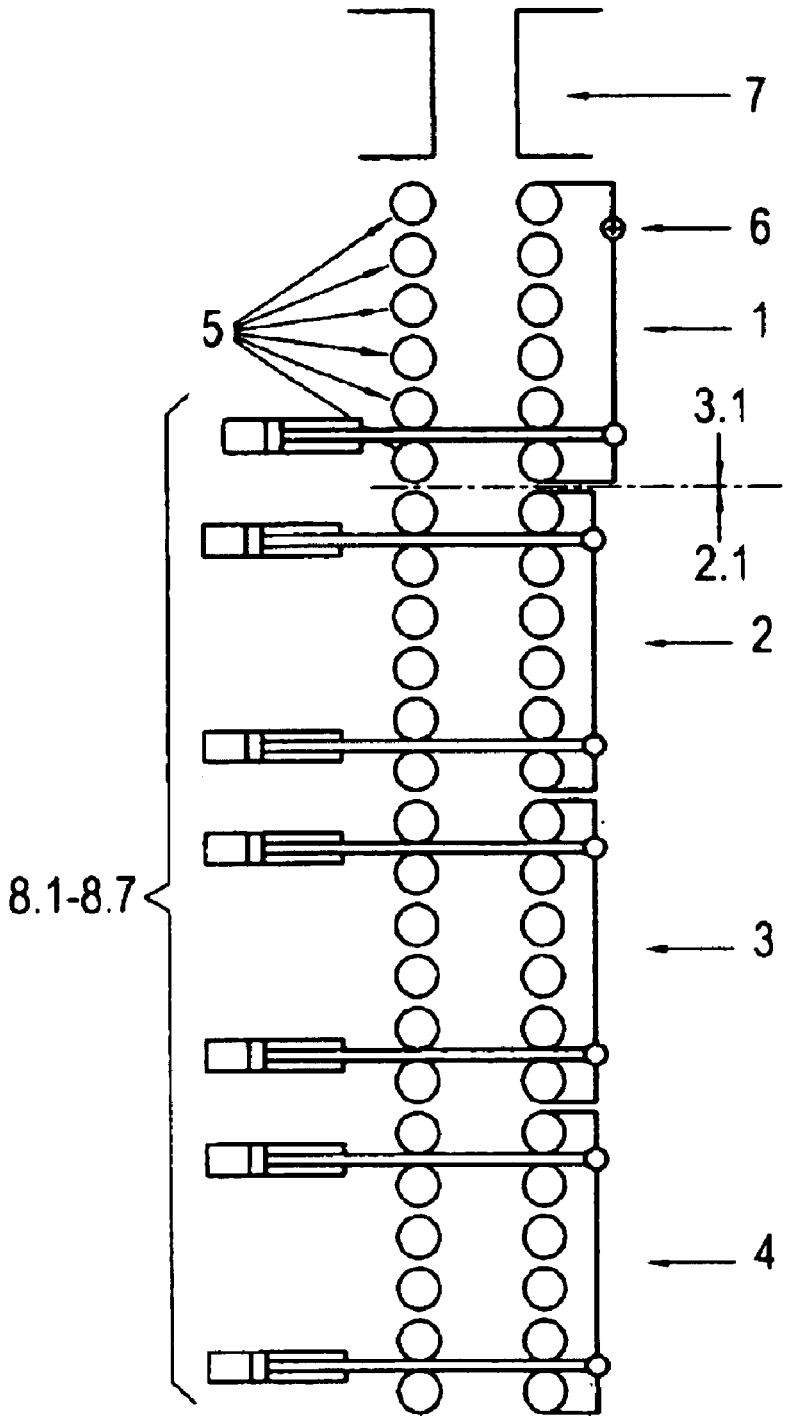
FIG. 1 shows the strand guide of a state-of-the-art continuous casting plant.

The design of the strand guide shown in FIG. 1 for a casting strand cast in the mold 7 conforms to the state of the art from which the present invention proceeds. As a unit, it consists of four segments 1 to 4, each of which has a strand run-in end 2.1 and a strand run-out end 3.1, with a pair of roll supports between them, which support a number of containment rolls 5 that extend over a containment zone, such that the roll supports, which are not separately shown in FIG. 1, can be adjusted at a mutual distance by means of hydraulic adjusting units 8.1 to 8.7 acting on the strand run-in end 2.1 or on the strand run-out end while overcoming both mechanical and ferrostatic forces. The adjusting units 8 are hydraulically acting piston-cylinder units.

Since the adjusting units 8.1 to 8.7 are shown in a side view, each adjusting unit shown in the drawing corresponds to a pair of hydraulic units. All together then, the prior-art strand guide shown in FIG. 1 has four roll segments 1 to 4 that act together as a unit with a total of fourteen individual hydraulic adjusting units 8.

In contrast to FIG. 1, FIGS. 2 to 5 show the design of the strand guide of a continuous casting plant in accordance with the invention.

In the strand guide of the invention, a flexible mechanical coupling 9 is present between adjacent segments. When a pair of cylinders 8.1 is installed at the strand run-in end 2.1 of a given segment 1 to 4, its adjusting movements occur both at this end 2.1 and simultaneously at the strand run-out end 3.1 of a preceding segment connected with the given segment. When a pair of cylinders 8 is installed at the strand run-out end 3.1 of a given segment 1 to 4, its adjusting movements occur both at this end 3.1 and simultaneously at the strand run-in end 2.1 of a following segment connected with the given segment. An important modification of the invention provides that the mechanical coupling 9 between adjacent segments is a releasable sliding joint coupling.

Figure 4:
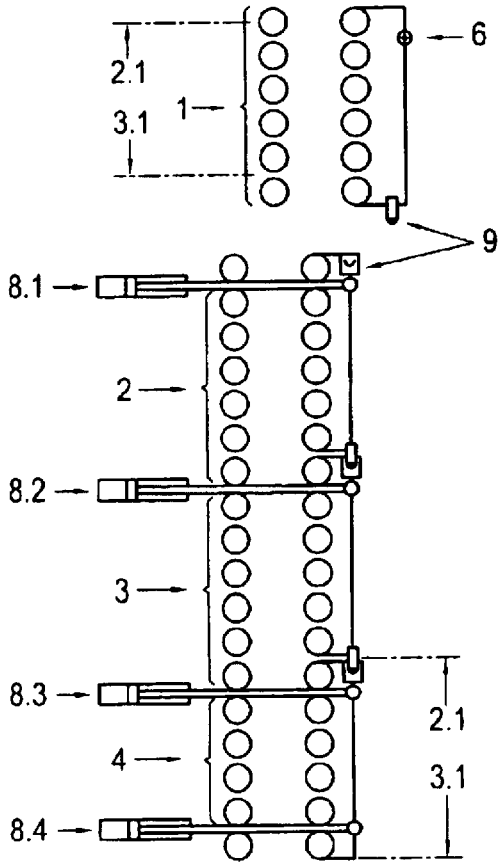
FIG. 4 shows the strand guide in accordance with the invention during disassembly of roll segment 1.

An advantage of a sliding joint coupling of this type is the uncomplicated assembly or disassembly, as is shown by way of example in FIG. 4.

Figure 2:
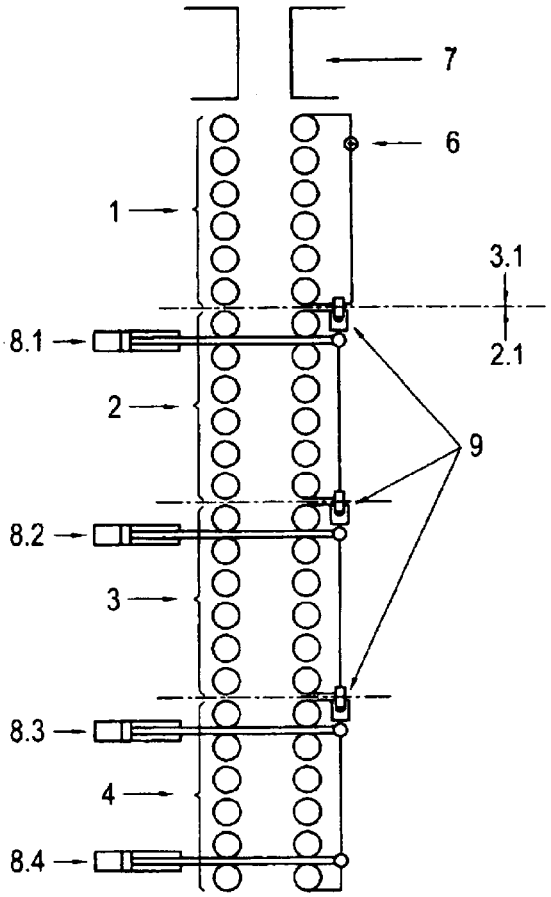
FIG. 2 shows a modification, in accordance with the invention, of the strand guide of a continuous casting plant with installation of hydraulic adjusting units at the strand run-in end.
Figure 3:
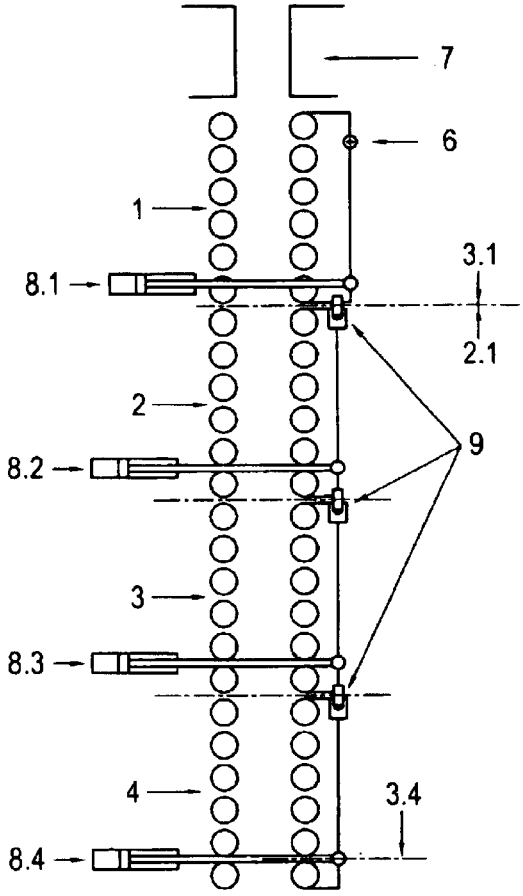
FIG. 3 shows a strand guide of a continuous casting plant with installation of the hydraulic adjusting units at the strand run-out end.

Each of the segments between the first and last segments 1, 4 has only one pair of cylinders 8, which is positioned either at the strand run-in end 2.1, as in FIG. 2, or at the strand run-out end 3.4. In this connection, it is apparent that, when all of the pairs of cylinders 8 are installed at the strand run-out end 3.1, as shown in FIG. 3, the first and last segments 1 and 4 are each assigned one pair of cylinders 8.1 to 8.4.

By contrast, FIG. 2 shows that when all of the pairs of cylinders 8.1 to 8.4 are installed at the strand run-in end 2.1, two pairs of cylinders 8.3 and 8.4 are assigned to the last segment 4 of the strand guide, one at the run-in end and one at the run-out end, while no hydraulic cylinder is assigned to the first segment 1, which follows the mold 7.

This design, in which there is no adjusting cylinder in segment 1, is a distinct improvement for variable strand guides that provide for a change in format thickness. In the event of a breakout, it is then possible to replace segment 1 with suitable replacement parts more easily, especially because there are no hydraulic connections and sensor connections to release or to close, and shorter changing times are thus achieved.

In this regard, the drawing in FIG. 4 shows the advantageously uncomplicated disassembly of segment 1 with disassembled flexible coupling 9, whose parts were merely fitted into one another. The disassembly work on the following segments 2 to 4 turns out to be similarly uncomplicated.

Figure 5:
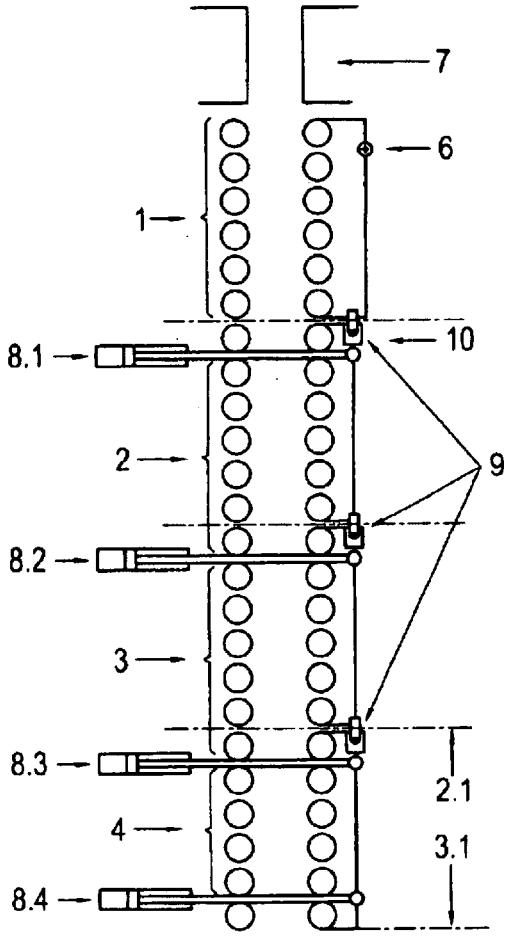
FIG. 5 shows a strand guide with the design of the invention during initiation of a thickness reduction for the casting strand.

FIG. 5 shows, with the adjustment of a pair of cylinders 8.1, 8.2, the initiation of a thickness reduction in the case of the strand guide design of the invention with only one pair of cylinders per segment, which is installed in the region of each flexible coupling 9. The hydraulic adjusting units are designed to transmit force in such a way that an adjusting movement acting on one end of a segment is also simultaneously transmitted to the other end of an adjacent segment in the same way and over the same distance.

An adjusting movement of the strand run-out end 3.1 of the next-to-last segment 3 produces a corresponding adjusting movement of the strand run-in end 2.1 of the last segment 4 of the strand guide. Simultaneously, corresponding to an adjusting movement of the strand run-in end 2.1 of the last segment 4, an adjusting movement of its strand run-out end 3.1 is hydraulically produced by the pair of cylinders 8.4.

What is claimed is:

1. A strand guide of a continuous casting plant, which comprises: at least two segments (1–4), each of which has a strand run-in end (2.1) and a strand run-out end (3.1) and a pair of roll supports; a number of containment rolls (5) supported by the roll supports so as to extend over a containment zone; adjusting units having cylinders (8) arranged to adjust the containment rolls; and a mechanical coupling (9) between the two segments of each set of adjacent segments, wherein a pair of the cylinders (8.1–8.4) is installed at the strand run-in end (2.1) of a segment (1–4), adjustment movement occurs both at the run-in end (2.1) of the segment and simultaneously at the strand run-out end (3.1) of a preceding segment to which the run-in end is connected, whereas, when a pair of cylinders (8.1–8.4) is installed at the strand run-out end (3.1) of a segment (1–4), adjustment movement occurs both at the run-out end (3.1) of the segment and simultaneously at the strand run-in end (2.1) of the following segment to which the run-out end is connected, each of the segments between the first segment (1) and the last segment (4) has only one pair of cylinders (8), which is positioned either at the strand run-in end (2.1) or at the strand run-out end (3.4).

2. The strand guide in accordance with claim 1, wherein the mechanical coupling (9) between adjacent segments is a releasable sliding joint coupling.

3. The strand guide in accordance with claim 1, wherein when all of the pairs of cylinders (8) are installed at the strand run-out end (3.1), one pair of cylinders (8.1–8.4) is assigned to the first and last segments (1) and (4), respectively.

4. The strand guide in accordance with claim 1, wherein when all of the pairs of cylinders (8.1–8.4) are installed at the strand run-in end (2.1), two pairs of cylinders (8.3) and (8.4) are assigned to the last segment (4) of the strand guide, one pair at the run-in end and one pair at the run-out end, and no hydraulic cylinder is assigned to the first segment (1), which follows the mold (7).

5. An adjusting method for segments of the strand guide of a continuous casting plant, which comprises at least two roll segments (1–4), each of which has a strand run-in end (2.1) and a strand run-out end (3.1) and a pair of roll supports, which can be adjusted by hydraulic adjusting units (8), the method including producing a flexible coupling (9) in adjacent segments (1–4) between the first segment (1) and the last segment (4), and operating the hydraulic adjusting units (8.1–8.4) to transmit force in the region of the connection so that an adjusting movement acting on one end (2.1) of a segment (1) is simultaneously transmitted to the other end (3.1) of an adjacent segment (2).

6. An adjusting method in accordance with claim 5, including producing a flexible coupling between the two segments of each set of adjacent segments (1–4) with a releasable sliding joint (9).

7. An adjusting method in accordance with claim 6, including transmitting the adjusting movement of the strand run-in end (2.1) of the second segment (2) to the strand run-out end (3.1) of the first segment (1) via the flexible coupling (9).

8. An adjusting method in accordance with claim 6, wherein the sliding joint (9) produces an adjusting movement in the same direction and over the same distance in the segments (1–4) that the sliding joint connects.

9. An adjusting method in accordance with claim 5, wherein an adjusting movement of the strand run-out end (3.1) of a next-to-last segment (3) produces a corresponding adjusting movement of the strand run-in end (2.1) of the last segment (4) of the strand guide.

10. An adjusting method in accordance with claim 5, wherein, corresponding to an adjusting movement of the strand run-in end (2.1) of the last segment (4), an adjusting movement at its strand run-out end (3.1) is separately produced by hydraulic means.

* * * * *